United States Patent [19]

Johnson, Jr.

[11] 4,068,760

[45] Jan. 17, 1978

[54] UTILITY RACK

[76] Inventor: Harvey C. Johnson, Jr., 315-17 N. 2nd St., Richmond, Va. 23219

[21] Appl. No.: 681,938

[22] Filed: Apr. 30, 1976

[51] Int. Cl.[2] ..... A47B 73/00

[52] U.S. Cl. ..... 211/74

[58] Field of Search ..... 211/71–76, 211/126, 128, 130, 69; 248/68, 152, 311 R, 146; 108/28; 220/20, 21; 206/45.34, 72, 223, 228, 232, 370; D7/70, 71, 76, 38; D9/176, 179; 53/285, 287, 318, 317, 329

[56] References Cited

U.S. PATENT DOCUMENTS

| | | | |
|---|---|---|---|
| 1,962,556 | 6/1934 | Eberhardt, Jr. | 211/74 |
| 2,765,136 | 10/1956 | Knapp | 248/68 R X |
| 2,897,973 | 8/1959 | Sizemore | 108/24 |
| 3,057,510 | 10/1962 | Blacker | D7/38 |
| 3,206,012 | 9/1965 | Braginetz | 206/228 |
| 3,233,744 | 2/1966 | Ripps | 108/28 X |
| 3,476,261 | 11/1969 | Hanson et al. | 211/74 |
| 3,935,944 | 2/1976 | Wilson et al. | 206/72 X |

*Primary Examiner*—Roy D. Frazier
*Assistant Examiner*—Terrell P. Lewis
*Attorney, Agent, or Firm*—Griffin, Branigan and Butler

[57] ABSTRACT

A utility rack is constructed of transparent sheet plastic having solid sidewalls, an open bottom, and a flat top wall positioned on an angle. Compartments extend into the rack from the top wall generally perpendicularly to the top wall. The compartments have drainage openings in the lower-most corners thereof.

At least one of the compartments is round for receiving round jars and the like. A wedge slot is formed in the side of the round compartment for receiving a wedge to hold round jars in this compartment immobile for screwing a closure member off of and onto it. A special compartment is formed in the rack for holding the wedge when it is not in use. Suction cups are included on the bottom of the rack to hold the rack to a support surface.

14 Claims, 4 Drawing Figures

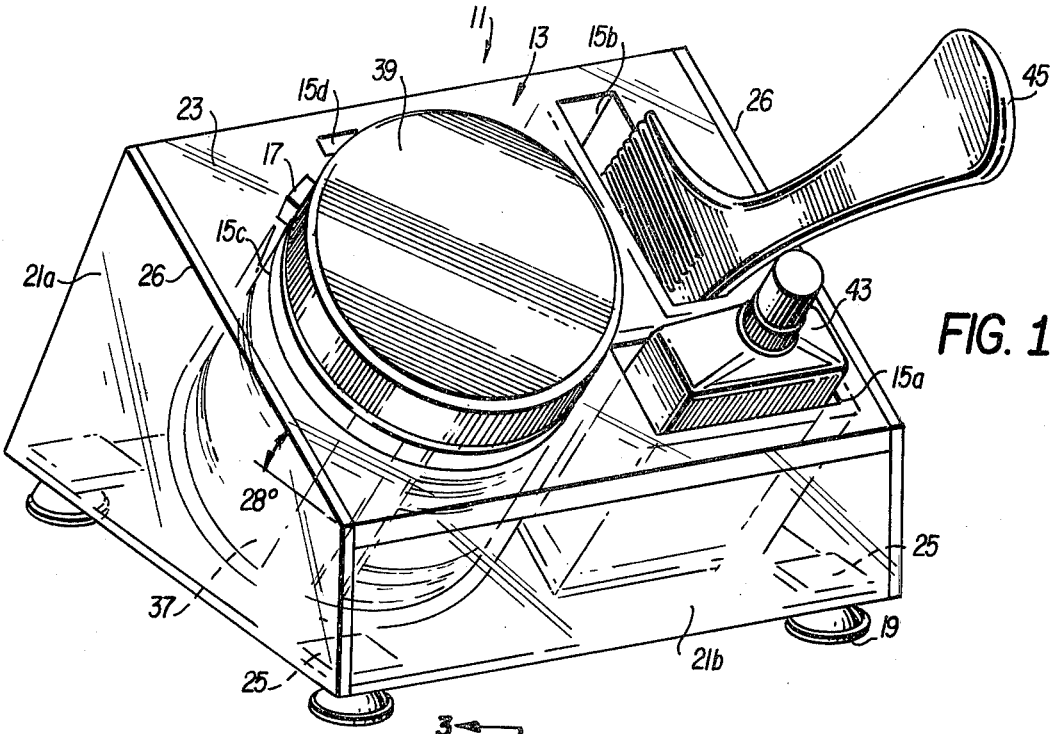
FIG. 1
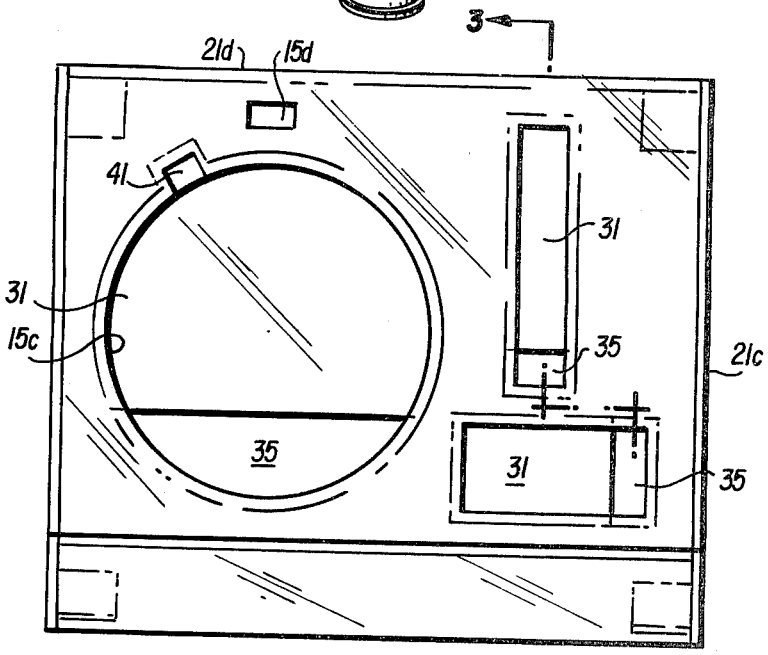
FIG. 2
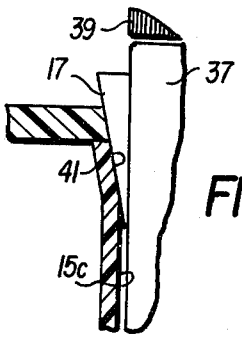
FIG. 4
FIG. 3
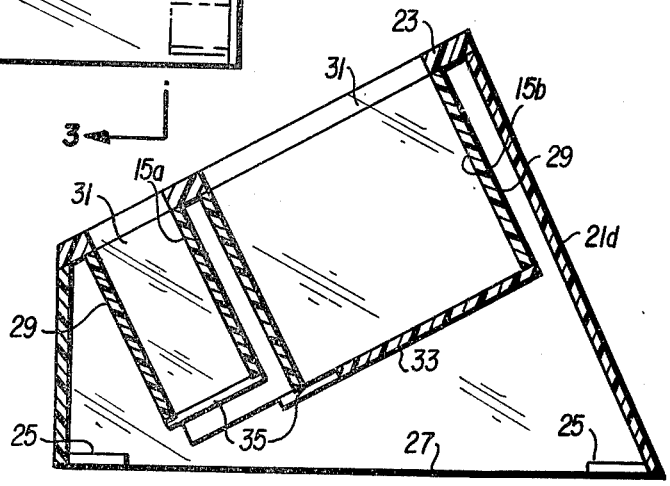

UTILITY RACK

BACKGROUND OF THE INVENTION

This invention relates generally to the art of portable utility racks, and more particularly, to such racks which are used to hold jars and the like as material is being taken therefrom by an operator, such as a hair dresser.

Numerous portable racks exist in the prior art for holding jars and the like from which an operator, or user, withdraws material to be applied to a subject. United States patents disclosing such racks include: No. 3,090,590 to Hester; 3,351,210 to Murcott; 3,467,259 to Silver; 3,476,261 to Hanson et al.; 3,602,371 to Weiner; Design Patent No. 9,718 to Cate; and Design Patent No. 208,469 to Parker. A primary purpose of such racks is to free operator's hands for working on the subject.

Some of the racks mentioned in the patents listed above are of molded plastic and have compartments formed in the tops thereof for receiving jars and the like, see Parker (Design Pat. No. 208,469); Cate (Design Pat. No. 9,718) and Murcott U.S. Pat. No. 3,351,210). A difficulty with the racks of these patents is that they do not provide proper structure for allowing material which dribbles down the sides of supported jars to fall out of, and/or be washed out of the compartments. Murcott U.S. Pat. No. (3,351,210) does include apertures in the centers of his compartments however material falling on the bottoms of these compartments does not necessarily flow out of these apertures since the bottoms are flat and this material might harden within the compartments before flowing out of the apertures. Thus, it is an object of this invention to provide a utility rack having compartments which include appropriate structure for allowing material dribbling down the sides of jars held by the compartments to easily and positively fall from the compartments.

Another difficulty with prior-art utility racks is that round jars held by the racks are generally free to rotate. Thus, it is difficult for an operator to screw off and on closure members thereof, especially with one hand. Thus, it is an object of this invention to provide a rack which immobilizes round jars to allow an operator to easily screw off and on closure members thereof with one hand.

It is further object of this invention to provide a utility rack for holding jars and the like which allows easy access to the jars.

It is also an object of this invention to provide a utility rack which is shaped to easily shed fluid material falling on the outer surface thereof.

It is yet another object of this invention to provide a utility rack which is inexpensive to manufacture has a relatively uncomplicated structure, is highly portable and is easy to clean.

SUMMARY

According to principles of this invention, a utility rack is constructed of solid transparent plastic. The utility rack has compartments extending at approximately a 28° angle with the vertical into the rack with drainage openings in the lower-most corners thereof. The rack further includes at least one wedge for wedging round jars in round compartments thereof for immobilizing the jars to allow an operator to screw off and on the tops thereof with one hand. The rack is transparent to allow the operator to read the labels of jars held by the rack.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an isometric view of a rack including principles of this invention holding jars and a comb;

FIG. 2 is an approximately top, plan view taken from a direction perpendicular to a top wall 23 of the rack of FIG. 1;

FIG. 3 is a sectional view taken on line 3—3 of FIG. 2; and,

FIG. 4 is a fragmented, partially-sectional, view of a portion of the rack of FIGS.1–3 showing a wedge holding a jar in a compartment of the rack.

DESCRIPTION OF THE PREFERRED EMBODIMENT

Referring to the drawings, a utility rack 11 includes a solid transparent plastic frame 13, solid, transparent, plastic compartments 15*a–d*, a wedge 17, and suction feet 19.

The frame 13 includes transparent side walls 21*a*–d, a flat, transparent top wall 23, and feet mounts 25. The top edges 26 of sidewalls 21*a* and *c* form approximately a 28° angle with the horizontal so that the plane of the top wall 23 also lies on approximately a 28° angle with the horizontal. The sidewall 21*b* is vertical, and the sidewall 21*d* is on a slight angle; however, this feature is not significant. The foot mounts 25 are only so large as is necessary to support the suction feet 19 at the bottom of the frame 13. Otherwise, the bottom 27 of the frame 13 is open to allow material dripping from the compartments 15*a–d* to fall out of the rack. The top wall 23 should form at least a 20° angle with the horizontal but should not be more than 45°.

The compartments 15*a–d* have solid, transparent side surface members 29 which are perpendicular to the top wall 23 of the frame 13. Thus, the compartments 15*a–d* extend into the frame 13 at an angle of 28° with the vertical. Again, this angle should be at least 20°, but not more than 45°. If the angle is too great, material can fall from the mouths of jars held by the rack. The side surface members 29 join to the top wall 23 at the edges of compartment openings 31 in the top wall 23. In addition, the compartments 15*a–d* include bottom surface members 33 which are also of transparent plastic. The bottom surface members 33 are shaped to leave drainage openings 35 which extend to the lower-most corners of the inner surfaces of the compartments 15*a–d*. Since the compartments are on an angle, and since the compartments have drainage openings in the lower-most corners thereof, any fluid (material falling from jars or the like) in the compartments naturally flows to the drainage openings 35 and out of the bottom 27 of the rack 11.

It should be noted that the compartments 15 have various shapes for holding various items. For example, a compartment 15*a* is rectangular in cross-sectional shape for holding a rectangular jar 43. In addition, compartment 15*b* is also rectangular for holding a comb. However, compartment 15*c* has a round cross sectional shape for receiving a round jar 37 having a screw-on closure top 39. The round compartment 15*c* includes a tapered wedge slot 41 at the upper, inner, surface thereof for receiving the wedge 17. The wedge 17 wedges in the wedge slot 41 against the round jar 37 to make the round jar 37 immobile relative to the utility rack 11. Thus, an operator can grip a screw-on closure top 39, and screw it from and onto the round jar 37 with one hand. That is, he does not need to hold the rack or the jar with his other hand while rotating the screw-on closure top 39. An additional compartment 15*d* is included above the round compartment 15*c* for holding the wedge 17 when it is not being used.

The suction feet 19 grip a supporting surface to hold the utility rack 11 against movement on its supporting surface.

It should be understood by those skilled in the art that the utility rack of this invention allows material falling from jars and the like to drain easily from the rack. In addition, the rack allows an operator to screw on and off the tops of jars held by the rack.

Further, the rack is relatively uncomplicated in structure and easy to manufacture. An additional and important feature of the rack is that it is transparent which enables an operator to read the labels of jars held by the rack. This features is particularly handy for beauty operators, and hairdressers, for example, who use jars which are color coded as to the relative strengths of materials in the jars.

Describing an operating procedure for a hairdresser using the rack of this invention, assume the jar 37 contains a hair relaxer, and the jar 43 contains a neutralizer. The operator places the jar 37 in the round compartment 15*c* and removes the wedge 17 from the compartmnet 15*d*. The operator pushes the wedge 17 between the jar 37 and the wedge slot 41 to immobilize the jar 37. The rectangular jar 43 is placed in the rectangular compartment 15*a* and a comb 45 is placed into the rectangular compartment 15*b*. The rack is then pushed downwardly against a surface so that its suction feet 19 grip the supporting surface. The operator then screws the closure top 39 from the relaxer jar 37 with one hand and removes the top from the neutralizer jar 43. The operator removes hair relaxer from the round jar 37 and applies it to the hair of a customer without fear of movement by the jar 37 relative to the rack 11 or by the rack 11 relative to its supporting surface. The operator rubs the relaxer into the hair using the back edge of the comb 45. If it appears that the relaxer is "burning" the skin of the customer the neutralizer jar 43 is removed from the rack and a small bit of neutralizer is applied to the skin at the irritated location. After use the rack can be easily placed in a sink and cleaned out for use with another customer.

It will be understood that the rack could similarly be used for giving a permanent by a operator, in which case, the various compartments would hold permanent solution, neutralizer, and so on.

If a rack is clean, and loaded, an operator can easily read labels to see whether the solutions loaded therein are of the proper strengths because the rack is transparent.

In the preferred embodiment, the transparent plastic is "plexiglas", although, other plastics can also be used.

While the invention has been particularly shown and described with reference to a preferred embodiment, it will be understood by those skilled in the art that various changes in form and detail may be made therein without departing from the spirit and scope of the invention. For example, the compartments 15*a–d* can be of other cross-sectional shapes and the rack frame can be shaped differently, although, it is important that the top surface thereof by on an angle and that the compartments extend into the rack on a substantial angle with the vertical. Not only does the top-surface angle hold the compartments in angled positions, but it also allows material falling on the top wall 23 to slide down the top wall and easily fall from the rack.

The embodiments of the invention in which an exclusive property or privilege are claimed are defined as follows:

I claim:

1. A utility rack for supporting at least one round container on a horizontal support surface for allowing a material to be easily scooped from said at least one round container without thereby rotating said container, said rack comprising a solid transparent plastic frame including solid sidewalls, an open bottom, and a flat top wall having receiving openings therein, said top wall forming an angle of between 20° and 45° with the horizontal when said rack is supported on said horizontal support surface, said rack further comprising a plurality of compartments positioned on the inside of said rack at each of said top-wall receiving openings, to receive and hold said items inserted into said receiving openings, said compartments being attached to said top wall and having solid, transparent plastic side-surface members which extend into said rack at an angle of between 20° and 45° with the vertical so that said compartments extend into said rack substantially perpendicularly to said top wall, said compartments further including solid bottom surface members each being shaped to form drainage openings in the lower-most corners of said compartments, at least one of said compartments having a round cross-sectional shape, to hold said at least one round container said rack further including a separate wedge for wedging between the exterior surface of said round container and the interior surface of said compartment to inhibit rotation of said round container relative to said rack, said rack also defining a means for engaging said wedge and thereby inhibiting rotation of said wedge relative to said rack.

2. A utility rack as in claim 1 wherein said angle formed by said top wall with the horizontal is approximately 28°.

3. A utility rack as claimed in claim 1 wherein is further included a mounting means for holding said rack to said horizontal support surface.

4. A utility rack as in claim 3 wherein said mounting means are suction cups.

5. A utility rack as in claim 1 wherein said means for engaging said wedge and thereby inhibiting rotation of said wedge relative to said rack is a slot in the wall of said at least one round compartment for receiving said wedge when said wedge is in a position for holding said round item immobile in said compartment.

6. A utility rack as in claim 5 wherein is further included a mounting means for holding said rack to said horizontal support surface.

7. A utility rack as in claim 5 wherein said angle formed by said top wall with the horizontal is approximately 28°.

8. A utility rack as claimed in claim 1 wherein is further included an extra compartment for holding said wedge when said wedge is not being used.

9. A utility rack as in claim 8 wherein is further included a mounting means for holding said rack to said horizontal support surface.

10. A utility rack for holding at least one round container for allowing material to be easily scooped from said at least one round container without thereby rotating said container, said rack comprising a solid transparent plastic frame including solid sidewalls, an open bottom, and a top wall having receiving openings therein, said rack further comprising a plurality of compartments positioned on the inside of said rack at each of said top-wall receiving openings to receive and hold said items inserted into said receiving openings, said compartments being attached to said top wall and having solid, transparent plastic side-surface members, at least one of said compartments having a round cross section and including a separate wedge means for inhibiting said round items in said round compartment against rotation relative to said utility rack, said wedge means wedging between the exterior surface of said round container and the interior surface of said compartment to inhibit rotation of said round container relative to said rack, said rack defining a means for inhibiting rotation of said wedge relative to said rack.

11. A utility rack as in claim 10 wherein said means for inhibiting rotation of said wedge relative to said rack is a slot in the wall of said compartment for receiving said wedge when said wedge is in a position for holding said round item immobile in said compartment.

12. A utility rack as claimed in claim 10 wherein is further included an extra compartment for holding said wedge when said wedge is not being used.

13. A utility rack as claimed in claim 10 wherein is further included a mounting means for holding said rack to said horizontal support surface.

14. A method of supporting a round container adjacent a beauty operator for allowing the beauty operator to scoop material from said round container with one hand without thereby rotating said container comprising the steps of:

mounting a rack having at least one round compartment adjacent to said beauty operator for receiving said round container, said compartment being positioned with its axis on an angle of between 20° and 45° with the horizontal;

inserting said round container in said round compartment;

inserting a wedge between the exterior surface of said round container and the interior surface of said round compartment to inhibit rotation of said round container relative to said round compartment.

* * * * *